US005421262A

United States Patent [19]

Mack et al.

[11] Patent Number: 5,421,262

[45] Date of Patent: Jun. 6, 1995

[54] CLEANING AND WASTE DISPOSAL SYSTEM WITHIN A PRODUCTION APPARATUS

[75] Inventors: Richard B. Mack, Heidelberg, Germany; Robert R. Murray, Madbury, N.H.

[73] Assignee: Heidelberg-Harris, Heidelberg, Germany

[21] Appl. No.: 210,067

[22] Filed: Mar. 16, 1994

Related U.S. Application Data

[63] Continuation of Ser. No. 944,056, Sep. 11, 1992, abandoned.

[51] Int. Cl.[6] ..... B41F 35/00

[52] U.S. Cl. ..... 101/424; 101/425

[58] Field of Search ..... 101/423, 424, 425; 110/211, 212

[56] References Cited

U.S. PATENT DOCUMENTS

| | | | |
|---|---|---|---|
| 4,116,128 | 9/1978 | Lehmann et al. | 101/425 |
| 4,686,902 | 8/1987 | Allaire et al. | 101/424 |
| 4,760,857 | 8/1988 | Shiba et al. | 101/425 |
| 4,774,884 | 10/1988 | Sugimoto et al. | 101/425 |
| 5,109,770 | 5/1992 | Uribe et al. | 101/425 |
| 5,199,362 | 4/1993 | Carter | 110/215 |

*Primary Examiner*—Ren Yan

*Attorney, Agent, or Firm*—Herbert L. Lerner; Laurence A. Greenberg

[57] ABSTRACT

A production apparatus has several printing units with collecting tanks for receiving wash residue. A cleaning and waste disposal system within the production apparatus includes a collection feeding pipe connected to the collecting tanks of the printing units. A central collecting tank which is connected to the collection feeding pipe contains a pump module. A thermal dryer has a burner system. A burner feeding pipe is connected between the central collecting tank and the burner system for guiding fluid from the central collecting tank, through the burner feeding pipe, to the burner system during a production run.

9 Claims, 2 Drawing Sheets

CLEANING AND WASTE DISPOSAL SYSTEM WITHIN A PRODUCTION APPARATUS

Figure 1:
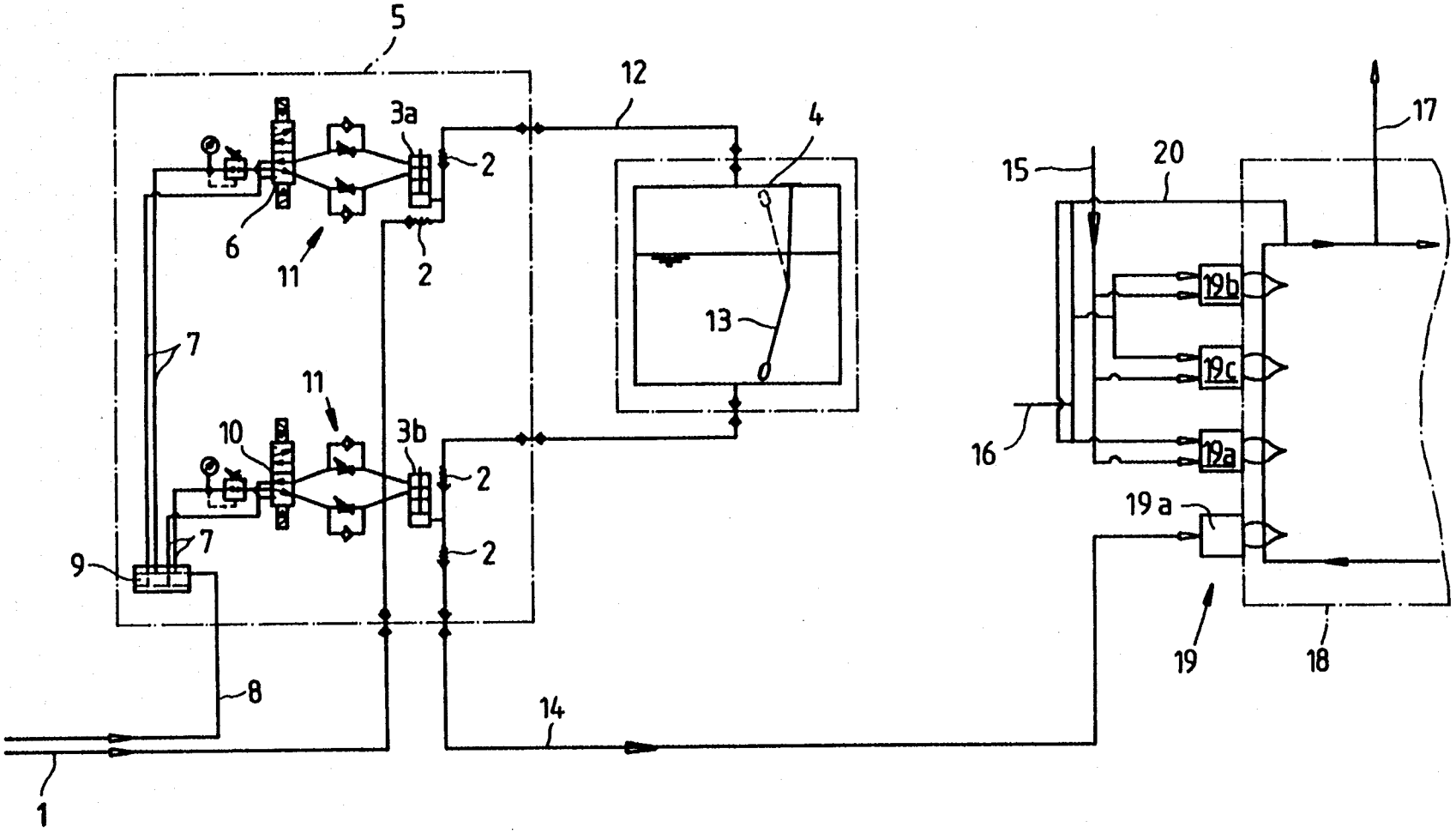

This application is a continuation of application Ser. No. 07/944,056, filed Sep. 11, 1992, now abandoned.

SPECIFICATION

The invention relates to a cleaning and waste disposal system within a production apparatus.

U.S. Pat. No. 4,686,902 discloses a rubber blanket cleaning system in which a mixture of water and solvent is circulating in a cleaning system. A collecting tank holding the solvent and the washing system are separated from one another by a valve system, making it possible to maintain the operating pressure in the washing system. Homogeneity of the water/solvent mixture is maintained through continuous mixing of water and solvent.

With the blanket cleaning system described in the afore-mentioned patent, only serial cleaning of the printing units of a rotary printing press is possible.

It is accordingly an object of the invention to provide a cleaning and waste disposal system within a production apparatus, which overcomes the hereinafore-mentioned disadvantages of the heretofore-known devices of this general type and which solves the technical problem of integrating a cleaning and waste disposal system into already existing machine components in rotary printing presses which allow the simultaneous cleaning of all printing units.

With the foregoing and other objects in view there is provided, in accordance with the invention, in a production apparatus, such as a rotary printing press facility, having several printing units with collecting tanks for receiving wash residue, a cleaning and waste disposal system comprising a collection feeding pipe connected to the collecting tanks of the printing units; a central collecting tank connected to the collection feeding pipe, the central collecting tank containing a pump module; at least one thermal dryer having a burner system; and a burner feeding pipe connected between the central collecting tank and the burner system for guiding fluid from the central collecting tank, through the burner feeding pipe, to the burner system during a production run of the rotary printing press, for incineration.

This solution offers several advantages. Wash residue is collected in a central collecting tank. Thus, no excess solvent is transported into the dryer through the web. Dissolved inks as well as dirt particles and similar contaminants are delivered through a pipe line system to the central collecting tank. After completion of the wash cycles, the solvent/cleaning agent mixture, which has been collected in the central collecting tank, can be fed to the burner system of the dryer, where it is burnt. Energy released by the combustion of the liquid being fed in, is used to reduce the amount of primary fuel used by the dryer. Since the central collecting tank serves as a buffer, more solvent in the printing unit can be used, which shortens the wash period. This assures a safe operation of the dryer. This cleaning and waste disposal system is utilized in the automation of the printing press.

In accordance with another feature of the invention, the pump module contains a pump for feeding the fluid into the central collecting tank.

In accordance with a further feature of the invention, the pump module contains a pump for feeding the fluid into the burner system of the dryer. This pump module is remotely controlled and is integrated into the utilities of the printing facility.

In accordance with an added feature of the invention, the central collecting tank contains a fail-safe level indicator that can be called up by means of a display.

In accordance with an additional feature of the invention, the release of the fluid feed from the central collecting tank into the dryer is fail-safe based on the operational parameters of the dryer. Self-regulation of the system can be reached, with remote indication of the fluid level in the central collection tank and control of the fluid flow into the dryer, to ensure that an adequate safety margin is maintained in the dryer (relative to a "lower flammability limit").

In accordance with yet another feature of the invention, there is provided a fluid feed through means of spraying jets into the burner system of the dryer. This facilitates mixing of minute droplets with combustion air, and helps to achieve complete incineration. The lower temperature of the air will ensure that the liquid does not vaporize in the supply line leaving behind residue which may clog the system.

In accordance with yet a further feature of the invention, there is provided a fluid feed into the dryer which takes place through a dripping device being formed of a pipe and a pre-heatable baffle plate. In this way, larger particles can also be fed into the dryer and be burnt.

In accordance with yet an added feature of the invention, there is provided a filtering and separating system which acts through circulation of the air in the room to remove gaseous solvents and cleaning agent components, and feeds them through a pump module to the central collecting tank. In this way, contamination of the air in work places with high solvent concentrations can be decreased and working conditions can be improved. Simultaneously, the condensate can be eliminated through burning in the dryer.

In accordance with a concomitant feature of the invention, there are provided means for reducing primary energy requirements of the dryer due to energy released from collected fluids.

Other features which are considered as characteristic for the invention are set forth in the appended claims.

Although the invention is illustrated and described herein as embodied in a cleaning and waste disposal system within a production apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
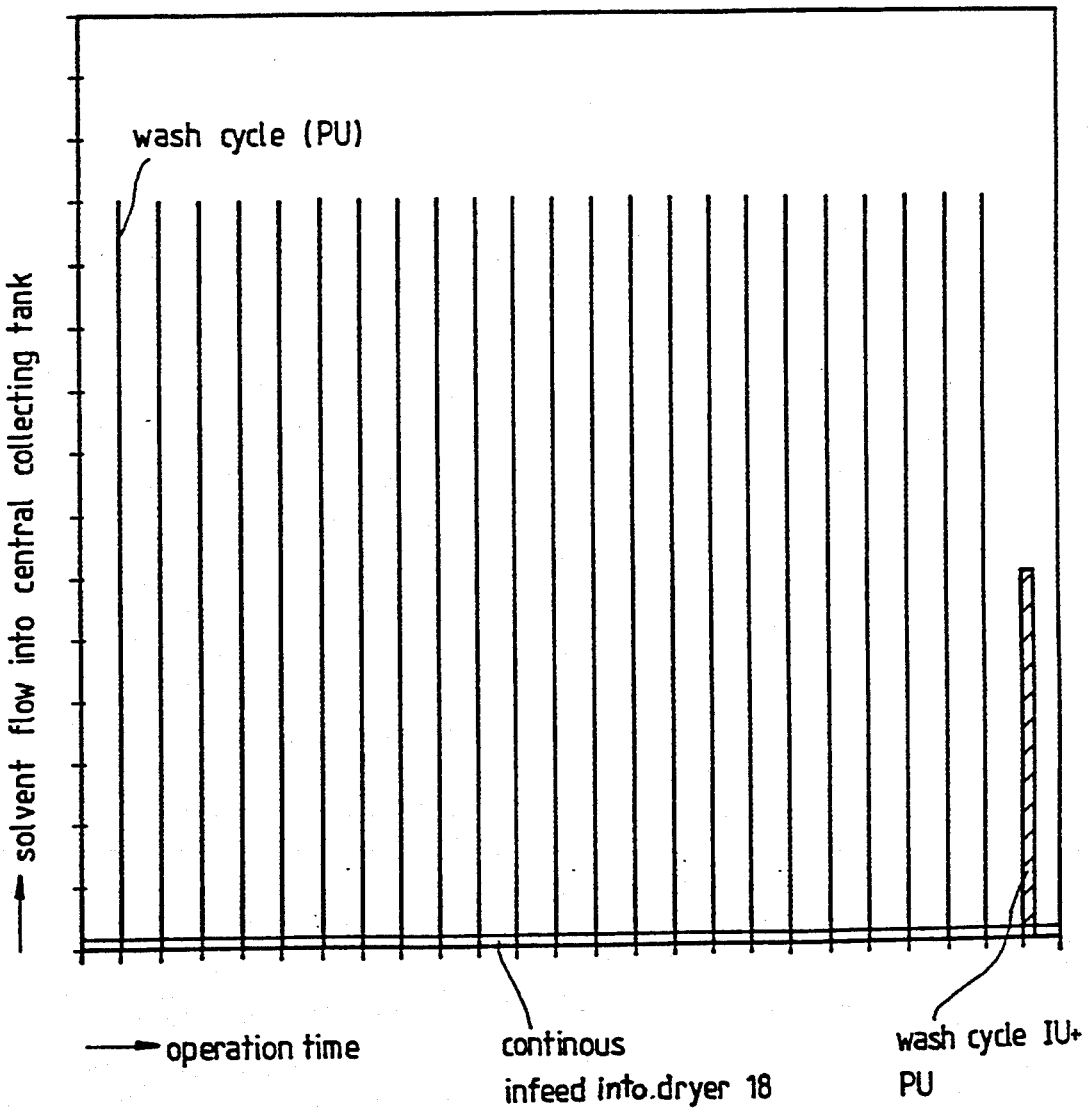

FIG. 1 is a schematic circuit diagram of a cleaning and waste disposal system; and FIG. 2 is a graph showing the fluid input and the fluid output in the central collecting tank.

Referring now to the figures of the drawing in detail and first, particularly, to FIG. 1 thereof, there is seen a preferred embodiment of the cleaning and waste disposal system according to the invention. A collection feeding pipe 1 connected to collecting tanks on individual printing units guides wash residue, solvent and cleaning agents into a central collecting tank 4. The conveyance takes place through a positive displacement pump 3*a* connected to a collecting tank feed pipe 12 containing two spring-loaded flap valves 2. A pump module 5 contains a distributor 9 for infeeding compressed air to the positive displacement pump 3*a* and to another positive displacement pump 3*b*. The distributor 9 of the pump module 5 is connected through a compressed air feeding pipe 8 with a central compressed air supply of the printing press. The compressed air is fed through compressed air supply lines 7 to pressure regulators 11. With the help of the pressure regulators 11, which provide excess pressure relief, the compressed air is supplied to the positive displacement pumps 3*a* and 3*b*. Activation of electric valves 6 and 10 at the positive displacement pumps 3*a* and 3*b*, is controlled by a central machine operating system.

The central collecting tank 4 contains an electric level indicator 13. In this way, an indication of the actual fluid level can be made to the machine operator, which is further described below in the description of the operational requirements of the cleaning and waste disposal system. The fluid mixture from the central collecting tank 4, which is conveyed through the positive displacement pump 3*b*, travels through a burner feed pipe 14 and reaches a dryer 18. There are also two spring-loaded flap valves 2 in the burner feed pipe 14.

The dryer 18 has a primary energy supply pipe 15 and an air supply pipe 16. The pipes 15 and 16 are connected to a burner system 19 so as to supply fuel as well as combustion air. Burners 19*b*, 19*c* and 19*d* of the burner system 19 have spraying jets indicated by arrow heads which are connected to the primary energy supply pipe 15 and to the air supply pipe 16. In contrast, a burner 19*a* has a spraying jet connected to the separate burner feeding pipe 14. Instead of the spraying jets, a dripping device formed of a pipe and a pre-heatable baffle plate 21 may be used. Furthermore, the dryer 18 provides recycled exhaust gases which are fed through a line 20 and are mixed with fresh air. Additionally, an exhaust pipe which has been designated with reference numeral 17 leads waste gas from the dryer 18 through a cleaning system to the outside.

A fluid input and a fluid output are illustrated in a diagram in FIG. 2. The diagram shows the fluid input into the central collecting tank 4 during the operation of the printing press. Given the fact that, on average, wash cycles take place in the printing unit at half-hour intervals, during the wash process ("wash cycle PU") in each printing unit a solvent mixture containing dissolved ink and paper particles is produced. Since this mixture which originates from the collecting tank at the printing units reaches the central collecting tank 4 which acts as a buffer, all of the printing units can be cleaned simultaneously during one washing process. The solvent mixture being input into the central collecting tank 4 allows the use of solvents having a low flash point. The normally used higher valued solvents, which have a higher flash point, are not required, since no solvent reaches the dryer by way of the web. After completion of the wash cycle in the printing units, normal production is resumed. During this normal production time, depending on the operational parameters occurring in the dryer 18, a continuous fluid flow is guided from the central collecting tank 4 into the burner 19*a* and is burnt in the dryer 18. The energy of the solvent is used for the heating of the dryer 18. A portion of primary energy previously fed to the dryer then can be saved, since the energy of the solvent contributes to the energy required for heating purposes.

During a production run, the solvent mixture which was produced during previous washing cycles is burnt. The solvent mixture produced during the next washing cycle (which is reproduced as a vertical line in a five-fold enlargement in FIG. 2) is guided into the central collecting tank 4. The process repeats itself indefinitely. In addition to the liquid components of the solvent mixture, it is also conceivable to feed solid particles such as dried ink residue, dirt and paper dust to the central collecting tank 4, to dissolve these in a separate section, and to remove them in the dryer 18 as well.

After completion of a production run, cleaning of the inking unit and printing unit of the rotary printing press is often performed for a change in production. This requires a large amount of solvent mixture (produced through a wash cycle IU+PU) which is also collected in the central collecting tank 4. In this washing process a larger amount of solvent is used, since the entire inking unit is being cleaned. The size of the central collecting tank 4 is dimensioned to handle this volume of fluid. During the following production run of the machine, this solvent mixture can also be fed into the dryer 18 for incineration.

For safety reasons, the operational parameters prevailing in the dryer 18 and the fluid level in the central collecting tank 4 are monitored. A "full tank" indication will prevent washing of the blankets. In contrast, if the central collecting tank 4 is empty, this fact is indicated to the machine as "tank empty". A washing process is then permitted. However, before a washing process is initiated, a verification of the following dryer parameters occurs:

safety against lower flash point,
burner flame on,
dryer temperature normal,
fluid in tank,
pump activation possible.

If all of these conditions are met, then the pump 3*b* can be actuated, and "system o.k." appears on a remote control. The message "tank empty" appears at the start of operation of the system, while simultaneously the message "wash cycle" is flashing. When the message "tank empty" expires, the message "system o.k." flashes in intervals, until the message "tank empty" appears again.

We claim:

1. In a production apparatus having several printing units with collecting tanks for receiving solvent/cleaning agent mixture, a cleaning and waste disposal system comprising:

a collection feeding pipe connected to the collecting tanks of the printing units;

a central collecting tank connected to said collection feeding pipe, said central collecting tank containing a pump module;

a thermal dryer having a burner system;

a burner feeding pipe connected between said central collecting tank and said burner system for guiding solvent/cleaning agent mixture from said central collecting tank, through said burner feeding pipe, to said burner system for burning the solvent/cleaning agent mixture during a production run; and including energy reducing means for reducing primary energy requirements of said dyer, wherein said reduced energy includes energy released from flammable solvent/cleaning agent mixtures.

2. The cleaning and waste disposal system according to claim 1, wherein said pump module contains a pump for for pumping solvent/cleaning agent mixture into said central collecting tank.

3. The cleaning and waste disposal system according to claim 1, wherein said pump module contains a pump for pumping solvent/cleaning agent mixture input into said burner system of said dryer.

4. The cleaning and waste disposal system according to claim 1, wherein said central collecting tank contains a monitorable and fail-safe level indicator.

5. The cleaning and waste disposal system according to claim 1, including means for adjusting the flow of solvent/cleaning agent mixture from said central collecting tank into said dryer in dependence on current operational parameters of said dryer.

6. The cleaning and waste disposal system according to claim 1, including jets through which solvent/cleaning agent mixture is input into said burner system of said dryer.

7. The cleaning and waste disposal system according to claim 1, including a dripping device having a pipe and a pre-heatable baffle plate for feeding the solvent/-cleaning agent mixture into said burner system of said dryer.

8. The cleaning and waste disposal system according to claim 1, including filtering means and separating means for filtering and separating gaseous solvent/-cleaning agent mixture components from air in a room connected to said pump module, said pump module operative for feeding said gaseous solvent/cleaning agent mixture components into said central collecting tank.

9. In a production apparatus having several printing units with collecting tanks for receiving solvent/cleaning agent mixture, a cleaning and waste disposal comprising:

a collection feeding pipe connected to the collecting tanks of the printing units;

a central collecting tank connected to said collection feeding pipe, said central collecting tank including a pump module;

a thermal dryer having a burner system;

a burner feeding pipe connected between said central collecting tank and said burner system for guiding said solvent/cleaning agent mixture from said central collecting tank through said burner feeding pipe to said burner system for burning the solvent/-cleaning agent mixture during a production run; and including energy reducing means connected with said dryer for reducing primary energy consumption of said dryer, said energy reducing means including means for recycling exhaust gases mixed with fresh air.

* * * * *